United States Patent [19]
Erdman et al.
[11] 4,208,888
[45] Jun. 24, 1980

[54] JEWELRY STORING AND DISPLAYING NATURAL PLACER GOLD

[76] Inventors: Ann L. Erdman, 13 Gordon Way, Princeton, N.J. 08540; James W. Shue, Harbourton Mt. Airy Rd., West Amwell, N.J. 08530

[21] Appl. No.: 922,775

[22] Filed: Jul. 7, 1978

[51] Int. Cl.[2] ..... A44C 25/00
[52] U.S. Cl. ..... 63/2; 63/23; 63/31
[58] Field of Search ..... 63/1, 4, 13, 23, 31; 428/3, 28

[56] References Cited

U.S. PATENT DOCUMENTS

| | | | |
|---|---|---|---|
| 121,440 | 11/1871 | Weiller | 63/1 R |
| 417,016 | 12/1889 | Gaynor | 63/23 |
| 3,412,576 | 11/1968 | Hodge | 63/4 |
| 4,142,383 | 3/1979 | Eberhart | 63/23 |

FOREIGN PATENT DOCUMENTS

| | | | |
|---|---|---|---|
| 766650 | 4/1934 | France | 63/1 R |
| 1337452 | 8/1963 | France | 63/1 R |

OTHER PUBLICATIONS

Jewellers' Circular-Keystone, p. 112 of Edition of Jan., 1978.

*Primary Examiner*—F. Barry Shay
*Attorney, Agent, or Firm*—Richard C. Woodbridge

[57] ABSTRACT

A hand blown glass vial is employed to hold and display nuggets, flakes and other particles of placer gold in its natural state. The vial includes an interior cavity having an irregular shape to emphasize the appearance of the natural gold. The top of the cavity can be sealed with a cap or crown means formed from natural metals, such as gold, alloyed with other metals such as silver and copper. The cap or crown includes a loop-means according to the preferred embodiment which is adapted to receive a gold chain or similar object for suspension and display. According to the preferred embodiment the vial takes the shape of a thermometer and includes at the bottom of the interior cavity, a rounded portion which slightly magnifys the gold contained therein. The device serves the three functions of protecting the precious gold metal in its natural state on the inside blending and reassembling the natural elements of quartz made into glass with the natural placer gold and other minerals such as silver and copper, while displaying the inherent beauty of the natural gold in unaltered form.

2 Claims, 9 Drawing Figures

JEWELRY STORING AND DISPLAYING NATURAL PLACER GOLD

BACKGROUND OF THE INVENTION

1. Field of the Invention

This invention relates to an item of jewelry for storing and displaying placer gold nuggets, flakes and other particles of placer gold in its natural state.

2. Description of the Prior Art

The use of display cases and the like is well-known in certain historical contexts. For example, religious reliquarys were often used to display small items of religious significance. More recently a ring was developed which included a setting of sliding diamonds and was sold through F. Staal, 743 Fifth Avenue, New York, New York.

Typically lode gold and the bulk of placer gold is altered from its natural state, purified and refined, melted into shapes such as bricks and then marketed for industrial, medical, or ornamental uses. The natural color, shape, texture, and unique qualities of the gold in its natural state are therefore lost and becomes somewhat artificial. It is also believed that refined gold flakes have been incorporated into items of jewelry on occasion. Solid gold nuggets are also sometimes worn on a necklace but it is impossible to view the entire nugget when worn in that fashion.

SUMMARY OF THE INVENTION

Briefly described the invention comprises an item of jewelry which allows the wearer to safely store and display placer gold nuggets, flakes and other particles of placer gold in its natural state. The invention provides a means of preserving and displaying the unique beauty and aesthetic qualities of the natural element of gold exactly as it exists in nature without being altered in any way. In addition, the art of nature is preserved by bringing quartz in the form of glass together with the placer gold elements found together in nature. The apparatus preferably comprises a vessel or vial in the shape of a bulb end of a thermometer and includes a cavity therethrough which extends to one open end. The cavity is partially filled with placer gold and is then capped at the open end with a tight, secure cap or crown. The cap includes a round loop which will receive a chain or other pendant suspending means. The glass vessel is formed from natural hand blown glass made from quartz and is therefore compatible with the natural placer gold. The cap is made of gold and alloyed so as to make a suitable protector for the open end of the interior cavity. According to other embodiments of the invention the vessel may assume such shapes as a pan as used for panning placer gold, a bottle, a tear drop, a star, a mushroom, a key, a wishbone, a butterfly, or a heart. These and other features of the invention will be more fully understood with reference to the following drawings and detailed description of the invention.

DETAILED DESCRIPTION OF THE INVENTION

During the course of this description like numbers will be used to identify like elements according to the different views of the invention.

Figure 1:
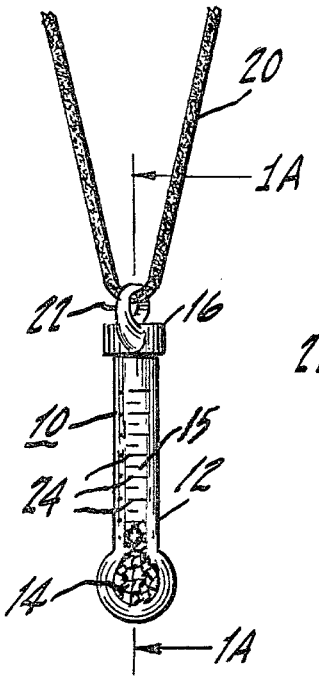
FIG. 1 is a side elevational view of the preferred embodiment of the present invention.
Figure 1A:
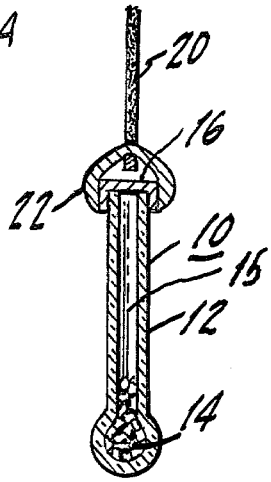
FIG. 1A is a cross-sectional view of the preferred embodiment illustrated in FIG. 1 as seen from perspective 1A—1A.

The preferred embodiment of the present invention 10 is illustrated in detail in FIGS. 1 and 1A. The invention 10 includes a hand blown glass vessel 12, an interior cavity 15 and a cap means 16. A closed loop 22 extends from one side of cap 16 to the other. The loop 22 is slightly twisted and includes an aperture therethrough which is sufficiently large to accomodate gold chain. The gold chain or necklace 20 is adapted to be worn around the neck of the wearer. Adaptions for earrings, pin, and rings are also possible.

The vessel 20 is made in the shape of a thermometer and includes temperature measuring marks 24 on the side of the cylindrical section thereof. The bottom of the vessel is terminated by a bulb-like protrusion having a spherical shape and similar in structure of the mercury containing portion of a conventional thermometer. The bulb portion serves several functions. Firstly, it accomodates a substantial quantity of placer gold 14. Secondly, the optical nature of the bulb tends to amplify and attract attention to the placer nuggets which then become more visible to the naked eye. Thirdly, in the context of a simulated thermometer the placer gold is analogous to mercury and could be sold under a suitable trademark such as "Gold Fever".

The materials of the invention 10 are formed entirely from natural elements. The vessel 12 is naturally formed from hand blown glass made from quartz. The cap is formed from 14 karat gold combined with 10 karats of copper and silver. Cap 16 is rigidly and firmly attached to the apparatus by a suitable epoxy and the tolerances of the cap are such as to insure a good fit. In order to preserve continuity the chain 20 is preferably a small gold link necklace, but it could comprise other suitable materials under other circumstances.

This particular apparatus is especially adapted to accomodate placer gold. Placer gold is the rarer form of gold. The U.S. Bureau of Mines reports that only 2% of all gold recovered in the U.S. today is placer gold. The other 99% is lode gold. In fact, for these purposes, placer gold is more valuable than a similar weight of refined gold. If the placer gold were melted down to form conventional gold, then it would lose some of its intrinsic natural value, a value not displayed by other natural or by-product forms of gold. By storing placer gold in a vessel 10 it is possible to obtain the maximum advantage from the natural placer gold 14 without having to melt it. The device illustrated in FIGS. 1 and 1A will hold approximately 1/14 of an ounce of placer gold. The slight twist in loop 22 can be useful in order to correctly center the necklace 20 and also because of its generally attractive shape. It may also be important to have the loop 22 span the sides of cap 16 so as to help stabilize the motion of the vessel 12. The stability of the vessel 12 can be important because the small placer gold particles 14 may be difficult to observe if they are in motion. Cross-sectional details of the preferred embodiment of the invention are clearly illustrated in cross-sectional view 1A.

The thermometer shape is a useful one for displaying the placer gold 14. By making the shape a little stubbier and the walls of the vessel 12 a little thicker it is possible to further emphasize the placer gold 14 and to produce a smaller vial 26, using a lesser quantity of placer gold 14. The alternative embodiment 26 of the general thermometer design is illustrated in detail in FIG. 2.

Figure 3:
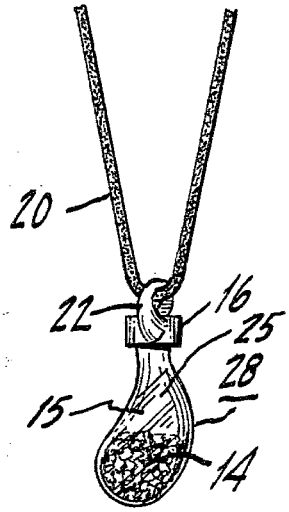
FIG. 3 is an alternative embodiment of the present invention in which the vessel has a tear drop-like shape.

While the thermometer shape is the preferred embodiment, there are other shapes that may be utilized for different effects. FIG. 3 illustrates a tear drop shape in which the vessel has a tear drop form and is asymmetrical along its long axis. In this embodiment it is desirable that the interior cavity 15 be slightly irregular in shape so as to distort and magnify the placer gold 14. Of course, as the placer gold 14 moves around it displays a changing pattern which is pleasing to the eye. In general it is also desirable to leave an air space 25 in the cavity 15 between the placer gold 14 and the cap 16. The air space 25 allows the particles 14 to freely rearrange themselves and also tends to emphasize the preciousness of the placer gold 14.

Figure 4:
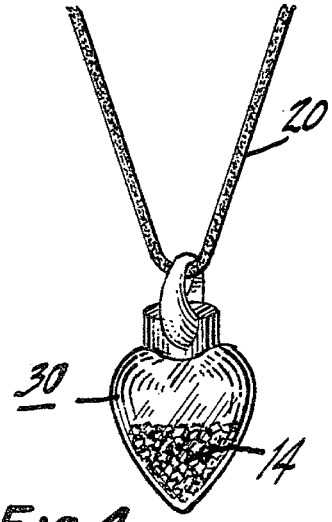
FIG. 4 is another alternative embodiment of the present invention in which the vessel has a heart-like shape.

A heart-shaped vessel 30 as illustrated in FIG. 4 comprises yet another embodiment of the present invention. The tapered shape of the interior cavity 15 tends to further emphasize the volume of the placer gold 14.

Figure 5:
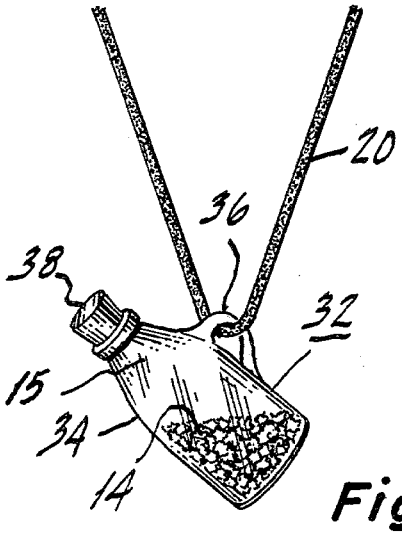
FIG. 5 is another alternative embodiment of the present invention in which the vessel has a jug or bottle-like shape.

Yet another embodiment of the present invention takes the shape of a jug or bottle 32. The vessel 34 of the jug embodiment 32 is also made of hand blown glass. The interior cavity 15 is capped by a small cork 38. A small loop 36 is formed integral with the exterior sidewall of the vessel 34 and is adapted to receive a gold chain 20 or cord. The embodiment of FIG. 5 is different from the embodiments of FIGS. 1 through 4 in that the loop 36 is not integral with the cavity cap 38. It can be desirable to have the loop and cavity cap located at the same position so that the display vessel remains relatively stable. Alternatively, if you want the display vessel to move, the embodiment of FIG. 5 can be attractive.

Figure 6A:
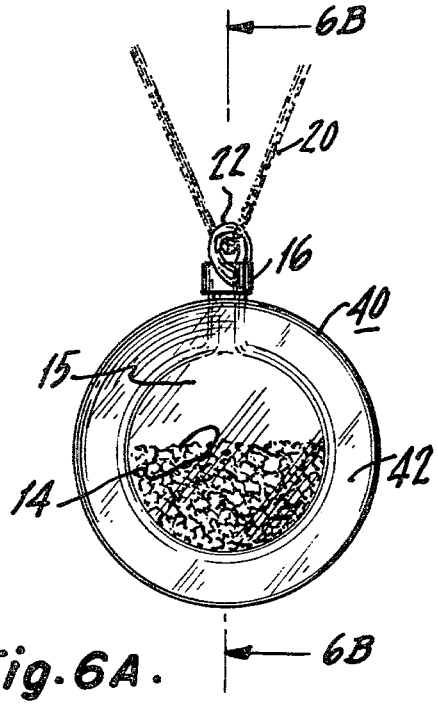
FIG. 6A is another alternative embodiment of the present invention in which the vessel has the shape of a gold pan.
Figure 6B:
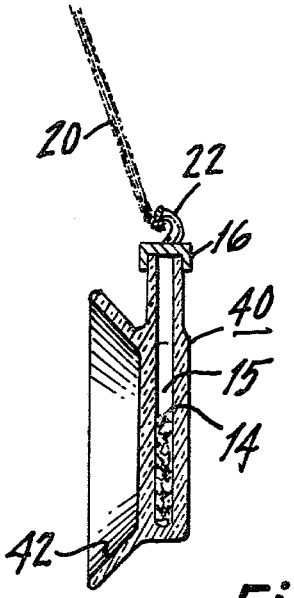
FIG. 6B is a cross-sectional view of the alternative embodiment illustrated in FIG. 6A.

A simulated gold pan 40 comprises another alternative embodiment and is illustrated in FIGS. 6A and 6B. The gold pan 40 is formed from a quartz glass composition and includes a peripheral rim 42 which frames the interior cavity 15 of the device.

Figure 7:
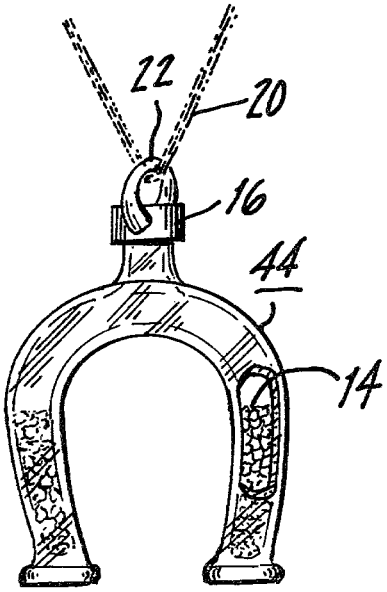
FIG. 7 is another alternative embodiment of the present invention in which the vessel has a horseshoe-like shape.

FIG. 7 illustrates another alternative embodiment in which the vessel 12 takes the shape of a horseshoe shaped vial 44.

Figure 2:
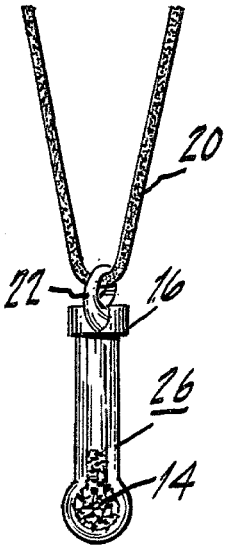
FIG. 2 is a stubbier embodiment of the apparatus described in FIGS. 1 and 1A.

The apparatus just described is typically produced in the following fashion. First a suitable vessel such as the thermometer shape of FIGS. 1 through 2 is carefully hand blown from natural glass materials. The interior cavity 15 is then partially filled (typically 5 to 50%) with placer gold 14. A gold cap 16 comprising 14 karat gold and 10 karats of copper and silver in alloy form is snuggly connected to the top of the vessel with a suitable epoxy. The twisted loop 22 may be welded or otherwise attached to the opposite sidewalls of the cap 16. Finally, a gold chain is placed through the loop 22 so that the apparatus may be worn as an item of decoration. The device thus created has an additional value above and beyond that of conventional jewelry because it allows the wearer to display placer gold 14 without destroying its natural intrinsic value.

While the invention has been described with reference to a preferred embodiment, it will be appreciated by those of ordinary skill in the art that various different changes might be made to the shape and form of the elements without departing from the spirit and scope of the invention.

We claim:

1. A display apparatus for storing placer gold particles, said apparatus comprising:

a plurality of placer gold particles in their natural unrefined state;

a substantially clear vessel of hand blown glass having an exterior shape suggestive of a thermometer and including a first cylindrical section having temperature markings thereon and a second bulb section connected to said first cylindrical section;

a cavity in said vessel for receiving said gold particles, said cavity extending from the exterior of said vessel towards the interior of said vessel so that the cavity extends uniformly through said first cylindrical section and expands to a rounded shape inside of the second bulb section, said placer gold particles filling approximately 50% of the volume of said cavity;

a cap means comprised of a metal alloy and connected to said vessel for capping said cavity;

a loop forming part of said cap means and passing from one side of said cap means to the other on a twisted path in a configuration adapted to coact with a suspending chain to stabilize motion of the vessel; and, a necklace means comprising a gold chain which passes through said loop in said cap means for attaching the display apparatus to a wearer, wherein said vessel serves to store said placer gold particles and said second bulb section of said vessel magnifies the particles.

2. The apparatus of claim 1 wherein the metal alloy of said cap means comprises a combination of copper, silver and gold.

* * * * *